US005622478A

United States Patent [19]

Elliott et al.

[11] Patent Number: 5,622,478

[45] Date of Patent: Apr. 22, 1997

[54] METHOD FOR HYDRAULIC GAS COMPRESSOR

[76] Inventors: Alvin B. Elliott; Angella D. Elliott, both of 301 E. Prospect St., Ponca City, Okla. 74601

[21] Appl. No.: 584,016

[22] Filed: Jan. 11, 1996

Related U.S. Application Data

[60] Division of Ser. No. 309,273, Sep. 20, 1994, which is a continuation-in-part of Ser. No. 258,813, Jun. 13, 1994, abandoned.

[51] Int. Cl.[6] ..... F04B 41/06; F15B 13/07

[52] U.S. Cl. ..... 417/53; 417/7; 417/533; 417/102; 222/3

[58] Field of Search ..... 417/2, 3, 4, 5, 417/6, 7, 8, 53, 102, 533; 222/3, 254, 265, 275

[56] References Cited

U.S. PATENT DOCUMENTS

| | | | |
|---|---|---|---|
| 665,567 | 1/1901 | Kemp . | |
| 1,839,878 | 1/1932 | Huber . | |
| 3,844,683 | 10/1974 | Albert | 417/7 |
| 4,321,016 | 3/1982 | Sakamoto et al. | 417/102 |
| 4,368,008 | 1/1983 | Budzich | 417/46 |
| 4,515,516 | 5/1985 | Perrine et al. | 417/38 |
| 4,536,131 | 8/1985 | Saito et al. | 417/102 |
| 4,547,132 | 10/1985 | Uchida et al. | 417/102 |
| 4,624,390 | 11/1986 | Palmer et al. | 222/3 |
| 4,666,374 | 5/1987 | Nelson | 417/3 |

*Primary Examiner*—Timothy Thorpe
*Assistant Examiner*—William Wicker
*Attorney, Agent, or Firm*—Dunlap & Codding, P.C.

[57] ABSTRACT

A gas compressor with at least three hydraulic cylinders is connected to a source of natural gas by a gas line. The gas line can also be removably attached to a storage tank. A hydraulic system is also connected to the cylinders. The compressor additionally includes pressure controls which allow the pistons in the hydraulic cylinders to complete the compression stroke in a staged manner. The cylinders are thereby sequentially emptied of gas. Gas at a sufficient initial pressure, entering the cylinders at the completion of the compression cycle, drives the return stroke of the pistons. A pressure switch controls the pressure level of the compressed gas, and aborts the compression cycle when a predetermined pressure in the storage tank has been reached. If the initial pressure of the natural gas from the gas source is insufficient, a low compression one stage compressor is connected to the gas line upstream of the gas compressor to pressurize the natural gas to sufficient initial pressure prior to introducing the gas into the gas compressor. A pressure distribution assembly having a pressure relief cylinder can also be attached to one or more of the hydraulic cylinders.

6 Claims, 3 Drawing Sheets

METHOD FOR HYDRAULIC GAS COMPRESSOR

CROSS REFERENCE TO RELATED APPLICATION

This is a divisional of application Ser. No. 08/309,273 filed on Sep. 20, 1994, which is a continuation-in-part of U.S. Ser. No. 08/258,813, filed on Jun. 13, 1994, now abandoned.

BACKGROUND OF THE INVENTION

Field of the Invention

The present invention relates to gas compressors, and more particularly, but not by way of limitation, to multi-stage hydraulic compressors for compressing flammable gases, such as natural gas.

DESCRIPTION OF THE PREFERRED EMBODIMENTS

Figure 1:
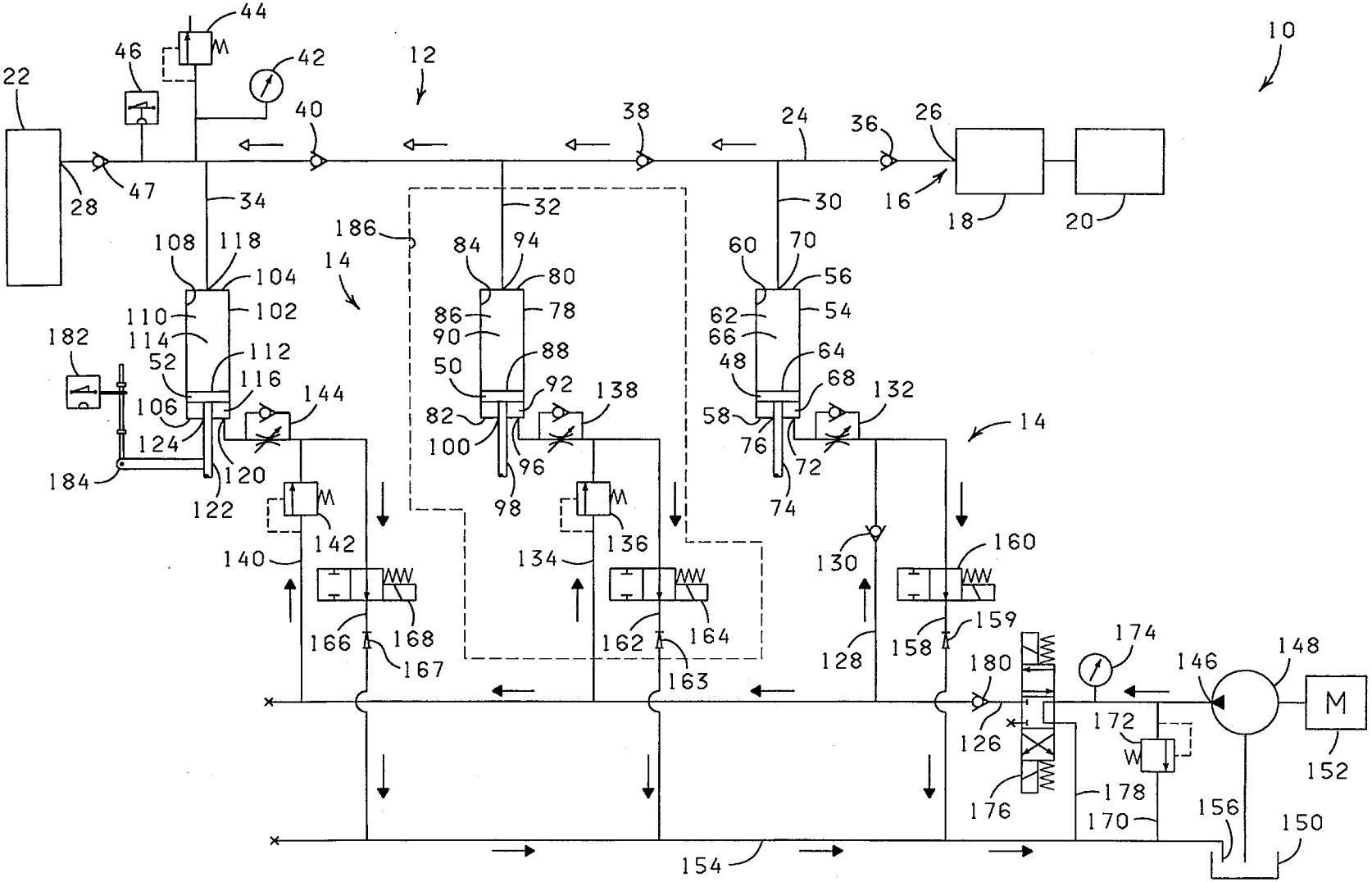
FIG. 1 is a schematic, diagrammatic view of a gas compressor constructed in accordance with the present invention.

Shown in FIG. 1 is a preferred embodiment of a hydraulic gas compressor constructed in accordance with the present invention and identified generally by the reference numeral 10. The compressor 10 includes a gas transfer assembly 12, a compression assembly 14, and a hydraulic assembly 16. The gas transfer assembly 12 is connected to the compression assembly 14, and the hydraulic assembly 16 is additionally connected to the compression assembly 14.

Gas is transported to the compression assembly 14 by way of the gas transfer assembly 12. The gas is compressed in the compression assembly 14 and compressed gas is transported from the compression assembly 14 by the gas transport assembly 12. The hydraulic assembly 16 transmits pressure via hydraulic fluid to the gas compression assembly 14, which enables the gas compression assembly 14 to compress the gas.

The gas transfer assembly 12 is connected at an upstream end 16 to a gas feed assembly 18 which is in turn connected to a natural gas source 20. The gas feed assembly 18 supplies gas to the gas transfer assembly 12 at an initially sufficient pressure of about forty to one hundred pounds p.s.i. and preferably of about eighty to one hundred pounds p.s.i. If the pressure of the gas at the natural gas source 20 is initially sufficient, the gas feed assembly 18 is omitted and the upstream end 16 of the gas transfer assembly 12 is connected directly to the natural gas source 20.

The gas transfer assembly 12 is also releasably connected in a conventional manner to a storage cylinder 22, which receives the compressed gas from the gas transfer assembly 12. In preferred embodiments of the invention, the storage cylinder 22 is onboard a vehicle (not shown) and is adapted to store compressed natural gas as fuel.

The gas transfer assembly 12 includes a gas line 24 extending from the upstream end 16 to the downstream end 20 of the gas transfer assembly 12. The gas line 24 is connected at a first end 26 to the gas feed assembly 20. The gas line 24 is also releasably connected at a second end 28 to the storage cylinder 22.

The gas line 24 is connected to the compression assembly 14 by way of a first conduit 30, a second conduit 32 and a third conduit 34. A check valve 36 is interposed in the gas line 24 between the first end 26 of the gas line 24 and the first conduit 30. A check valve 38 is additionally interposed in the gas line 24 between the first conduit 30 and the second conduit 32. A check valve 40 is further interposed in the gas line 24 between the second conduit 32 and the third conduit 34. The check valves 36, 38 and 40 permit the flow of gas through the gas line 24 from the upstream end 16 of the gas transfer assembly 12 to the downstream end 20 of the gas transfer assembly 12, while generally restricting the flow of gas through the gas line 24 from the downstream end 20 to the upstream end 16 of the gas transfer assembly 12.

A pressure gauge 42 and a relief valve 44 are interposed in the gas line 24 generally between the third conduit 34 and the second end 28 of the gas line 24. The relief valve 44 is set at a predetermined relief pressure. If the pressure in the gas line 24 increases beyond the predetermined relief pressure for any reason, the relief valve 44 opens, allowing pressurized gas within the gas line 24 to escape to the atmosphere or into a vent tank (not shown).

A pressure switch 46 and a check valve 47 are interposed in the gas line 24 between the relief valve 44 and the second end 28 of the gas line 24. The pressure switch 46 is set to a predetermined switch pressure. The pressure switch 46 opens if the pressure in the gas line 24 exceeds the predetermined switch pressure. Opening the pressure switch 46 stops the compression cycle, as will be explained below. Gas is thereby prevented from flowing into the storage cylinder 22 through the second end 28 of the gas line 24.

If the pressure in the gas line 24 falls below the predetermined switch pressure, the pressure switch 46 closes, starting the compression cycle and allowing gas to flow into the storage cylinder 22. The check valve 47 prevents the backflow of gas from the storage cylinder 22 to the gas line 24.

It has been found satisfactory to construct the gas line 24 of pressure resistant ⅜" diameter pipe rated at about 5000 p.s.i., whereas the first, second and third conduits 30, 32 and 34 are constructed of pressure resistant ¼" diameter pipe rated at about 5000 p.s.i. Sections of pressure resistant pipe are threaded to connect to the hardware discussed above and to the compression assembly 14. Although pressure resistant pipe has been used herein, in other embodiments of the gas compressor 10, the gas line 24 and the first, second and third conduits 30, 32 and 34 can be constructed of other materials known to the art, such as pressure hose or hydraulic line.

The compression assembly 14 is connected to the gas transfer assembly 12 by way of the first, second and third conduits 30, 32 and 34 in order to permit gas to pass into and out of the compression assembly 14. While the compression assembly 14 may include three or more hydraulic cylinders, the embodiment of the compression assembly 14 shown in FIG. 1 includes a first hydraulic cylinder 48, a second hydraulic cylinder 50 and a third hydraulic cylinder 52. The first, second and third hydraulic cylinders 48, 50 and 52 are generally vertically oriented, as shown in FIG. 1.

The first hydraulic cylinder 48 of the compression assembly 14 includes a closed sidewall 54 having an upper end 56, a lower end 58 and an interior surface 60. The interior surface 60 defines an interior cavity 62 having a piston 64 slidingly contained therein. The piston 64 is sized and constructed to provide a seal between the piston 64 and the interior surface 60 of the closed sidewall 54 of the first hydraulic cylinder 48. The interior cavity 62 and the piston 64 further define a gas area 66 and a fluid area 68.

The first hydraulic cylinder 48 also is provided with an upper port 70 formed through the upper end 56 of the closed sidewall 54. A lower port 72 is formed through the lower end 58 of the closed sidewall 54 of the first hydraulic cylinder 48. The first hydraulic cylinder 48 further includes a piston rod 74 movably attached to the piston 64 and extending through the lower end 58 of the closed sidewall 54 via an aperture 76.

The second hydraulic cylinder 50 is constructed in a similar manner to that of the first hydraulic cylinder 48. The second hydraulic cylinder 50 of the compression assembly 14 includes a closed sidewall 78 having an upper end 80, a lower end 82 and an interior surface 84. The interior surface 84 defines an interior cavity 86 having a piston 88 slidingly contained therein. The piston 88 is sized and constructed to provide a seal between the piston 88 and the interior surface 84 of the closed sidewall 78 of the second hydraulic cylinder 50. The interior cavity 86 and the piston 88 further define a gas area 90 and a fluid area 92.

The second hydraulic cylinder 50 also is provided with an upper port 94 formed through the upper end 80 of the closed sidewall 78. A lower port 96 is formed through the lower end 82 of the closed sidewall 78 of the second hydraulic cylinder 50. The second hydraulic cylinder 50 further includes a piston rod 98 movably attached to the piston 88 and extending through the lower end 82 of the closed sidewall 78 via an aperture 100.

The third hydraulic cylinder 52 is constructed similarly to the first and second hydraulic cylinders 48 and 50. The third hydraulic cylinder 52 of the compression assembly 14 includes a closed sidewall 102 having an upper end 104, a lower end 106 and an interior surface 108. The interior surface 108 defines an interior cavity 110 having a piston 112 slidingly contained therein. The piston 112 is sized and constructed to provide a seal between the piston 112 and the interior surface 108 of the closed sidewall 102 of the third hydraulic cylinder 52. The interior cavity 110 and the piston 112 further define a gas area 114 and a fluid area 116.

The third hydraulic cylinder 52 also is provided with an upper port 118 formed through the upper end 104 of the closed sidewall 102. A lower port 120 is formed through the lower end 106 of the closed sidewall 102 of the third hydraulic cylinder 52. The third hydraulic cylinder 52 further includes a piston rod 122 movably attached to the piston 112 and extending through the lower end 106 of the closed sidewall 102 via an aperture 124.

Different types and sizes of hydraulic cylinders may be used as the first, second and third hydraulic cylinders 48, 50 and 52 of the compression assembly 14. However, desirable results have been achieved where the first, second and third hydraulic cylinders 48, 50 and 52 are Cross Corporation 3½" diameter welded hydraulic cylinders rated at three thousand p.s.i.

The compression assembly 14 is connected to the hydraulic assembly 16 by way of the lower ports 72, 96 and 120 of the first, second and third hydraulic cylinders 48, 50 and 52. The hydraulic assembly 16 supplies hydraulic fluid sequentially to the first, second and third hydraulic cylinders 48, 50 and 52. The hydraulic assembly also permits the hydraulic fluid to drain sequentially from the first, second and third hydraulic cylinders 48, 50 and 52.

The hydraulic assembly 16 includes a pressure line 126. The pressure line 126 is connected to the lower port 72 of the first hydraulic cylinder 48 by way of a first receiving line 128. A check valve 130 is interposed in the first receiving line 128. A flow control valve 132 is also interposed in the first receiving line 128 between the check valve 130 and the lower port 72 of the first hydraulic cylinder 48.

The pressure line 126 further is connected to the lower port 96 of the second hydraulic cylinder 50 by way of a second receiving line 134. A relief valve 136 is interposed in the second receiving line 134. A flow control valve 138 is additionally interposed in the receiving line 134 between the line relief valve 136 and the second lower port 96 of the second hydraulic cylinder 50.

The pressure line 126 still further is connected to the lower port 120 of the third hydraulic cylinder 52 by way of a third receiving line 140. A relief valve 142 is interposed in the third receiving line 140, and a flow control valve 144 is also interposed in the third receiving line 140 between the relief valve 142 and the lower port 120 of the third hydraulic cylinder 52.

The pressure line 126 is also connected at an end 146 to a pump 148, which is in turn connected to a reservoir 150. The pump 148 is positioned to draw hydraulic fluid from the reservoir 150 and pump the hydraulic fluid under pressure through the pressure line 126, and through the first, second and third receiving lines 128, 134 and 140 into the fluid areas 68, 92 and 116 of the first, second and third hydraulic cylinders 48, 50 and 52.

Any commercially available pump capable of delivering hydraulic fluid under sufficient pressure can be employed as the pump 148. For example, desirable results have been obtained wherein the pump 148 is a J. S. Barnes Corporation High Pressure Gear Pump, No. 736049R. The pump 148 can be powered by any convenient method, such as by use of an electric motor 152. In this embodiment, the electric motor 152 is a five horsepower AC electric motor, geared to provide the proper drive.

The pressure line 126 and the first, second and third receiving lines 128, 134 and 140 can be constructed of any material and in any conventional manner known to the art. For example, pressure hose or hydraulic line may be used. In this embodiment of the invention, it has been found satisfactory to use ½ diameter pressure resistant pipe rated at 5000 p.s.i.

The hydraulic assembly 16 also includes a return line 154 with an end 156 connected to the reservoir 150. The return line 154 receives hydraulic fluid which drains from the fluid areas 68, 92 and 116 of the first, second and third hydraulic cylinders 48, 50 and 52. The return line 154 returns the received hydraulic fluid to the reservoir 150, where the fluid is available to be returned by the pump 148 to the pressure line 126. In this embodiment of the invention, the return line has been constructed satisfactorily of 1" diameter steel pipe.

The return line 154 is connected to a first outflow line 158, a second outflow line 162, and a third outflow line 166. The first, second and third outflow lines 158, 162 and 166 provide a return path to the return line 154 for hydraulic fluid drained from the first, second and third hydraulic cylinders 48, 50 and 52.

The first outflow line 158 is connected to the first receiving line 128 between the check valve 130 and the flow control valve 132. The first outflow line 158 has a swedge 159 and a solenoid valve 160 interposed therein and is further connected to the return line 154.

The second outflow line 162 is connected to the second receiving line 134 between the relief valve 136 and the flow control valve 138. The second outflow line 162 has a swedge 163 and a solenoid valve 164 interposed therein and is further connected to the return line 154.

The third outflow line 166 is connected to the third receiving line 140 between the relief valve 142 and the flow control valve 144. The third outflow line 166 has a swedge 167 and a solenoid valve 168 interposed therein and is further connected to the return line 154. In this embodiment of the invention, it has been found satisfactory to use a Hydraforce, Inc. Solenoid, Model No. 6316115, in combination with a Sun Corporation Valve, Model No. 7026630, for the solenoid valves 160, 164 and 168.

In this embodiment of the invention, sections of the first, second and third outflow lines 158, 162 and 166 are constructed of ½ diameter pressure resistant pipe, rated at about 5000 p.s.i. Additional sections of the first, second and third outflow lines 158, 162 and 166 between the swedges 159, 163 and 167 and the receiving line 154 are constructed of 1" diameter steel pipe.

A relief line 170 having a relief valve 172 is connected to the pressure line 126 and to the return line 154. A pressure gauge 174 is interposed in the pressure line 126 between a four way solenoid valve 176 and the connection of the pressure line 126 to the relief line 170. The four way solenoid valve 176 is additionally connected to a bypass line 178, which is further connected to the return line 154. A check valve 180 is interposed in the pressure line 126 between the four way solenoid valve 176 and the connection of the pressure line 126 with the first receiving line 128. An example of the four way solenoid valve 176 that has proved satisfactory for use in this embodiment of the gas compressor 10 is Parker Corp. Valve Model No. DIVW8CNYC 70 with a tandem center section.

As shown in FIG. 1, the hydraulic assembly 16 additionally includes a limit switch 182. The limit switch 182 is connected to a control rod 184; and the control rod 184 is connected to the piston rod 122 of the third hydraulic cylinder 52.

Figure 2:
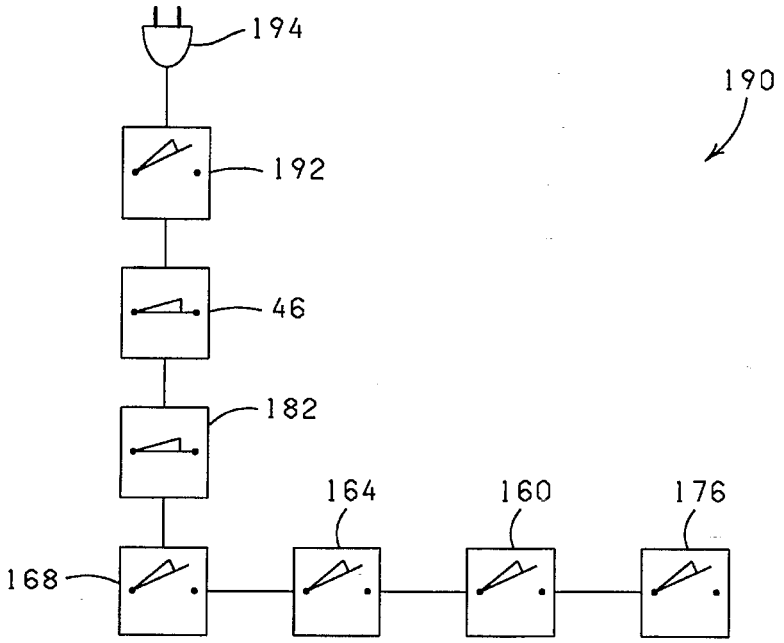
FIG. 2 is a schematic, diagrammatic view of an electrical circuit of the gas compressor of FIG. 1.

Turning to FIG. 2, an electrical circuit 190 is shown which is used with the embodiment of the invention shown in FIG. 1. The circuit 190 includes a switch 192 connected to an electric current source 194. The switch 192 is further connected in series to the pressure switch 46, the limit switch 182, the solenoid valves 168, 164 and 160, and the four way solenoid valve 176. Electric current to the solenoid valves 168, 164 and 160 and to the four way solenoid valve 176 can be controlled by the pressure switch 46 or the limit switch 182.

As will be appreciated, the electrical and mechanical hardware from which the gas compressor 10 is constructed can be changed in accordance with known principles of hydraulic design. For example, the sizes of the first, second and third hydraulic cylinders 48, 50 and 52 can be varied for particular applications. The size of the first, second and third hydraulic cylinders 48, 50 and 52 used in the embodiment of the gas compressor 10 shown in FIG. 1 may prove suitable for a home gas compression station.

For different applications, larger cylinders can be used to give a greater output of compressed gas to the storage cylinder 22. Additionally, explosion proof hardware can be substituted for the electrical hardware, such as the solenoid valves 160, 164, 168 and 176. Alternately, the electrical hardware can be isolated behind a barrier.

The compressor 10 can be modified to include additional compression stages, for example by including two or more second hydraulic cylinders 50. The second hydraulic cylinder 50 and its associated hardware can be further described as an expansion module and given the additional reference numeral 186, as shown in FIG. 1. By connecting additional expansion modules 186 to the gas transfer assembly 12 and the hydraulic assembly 16, a gas compressor 10 can be constructed having as many compression stages as desired for a given application.

Additionally, FIG. 1 shows that one port of the four way solenoid valve 176 is plugged. By connecting a second pressure line 126 to the four way solenoid valve 176 and by connecting the unused solenoid of the four way solenoid valve 176 to a switchable electric circuit, a second hydraulic assembly 16 attached to a second gas compressor 10 can be connected to the gas compressor 10. The second gas compressor 10 can serve as an alternate or backup compressor for the gas compressor 10.

As explained below gas from the natural gas source 20 preferably will have an initial pressure from about forty to one hundred p.s.i and preferably from about eighty to one hundred p.s.i. If the initial pressure of the gas at the natural gas source 20 is insufficient, the gas feed assembly 18 can be interposed in the gas line 24 between the gas line 24 and the natural gas source 20 to raise the gas pressure to a sufficient level.

Figure 3:
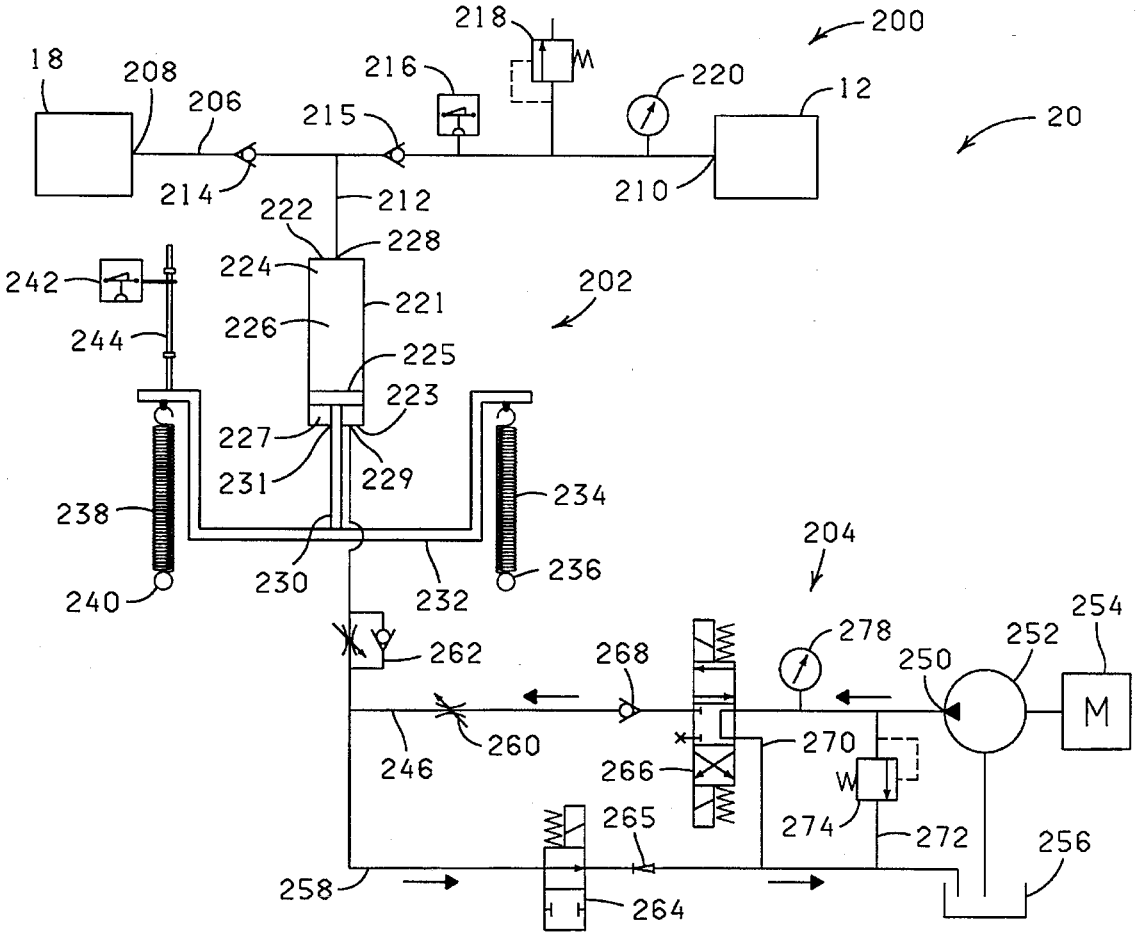
FIG. 3 is a schematic, diagrammatic view of a gas feed assembly for use with the gas compressor of FIG. 1.

The gas feed assembly 18 shown in FIG. 3 comprises a gas transfer assembly 200 connected to a compression assembly 202 and a hydraulic assembly 204 connected to the compression assembly 202. The gas transfer assembly 200 is connected to the natural gas source 20 the gas transfer assembly 12 of the gas compressor 10.

The gas transfer assembly 200 of the gas feed assembly 18 transports gas from the natural gas source 20 to the compression assembly 202 and from the compression assembly 202 of the gas feed assembly 18 to the gas transfer assembly 12 of the gas compressor 10.

The compression assembly 202 of the gas feed assembly 18 accepts gas from the natural gas source 20, compresses the gas, and delivers the gas, via the gas transfer assembly 200 of the gas feed assembly 20 to the gas transfer assembly 12 of the gas compressor 10. The hydraulic assembly 204 of the gas feed assembly 18 provides hydraulic fluid under pressure to the compression assembly 202 and drains the hydraulic fluid from the compression assembly 202 of the gas feed assembly 20.

The gas transfer assembly 200 of the gas feed assembly 18 includes a gas line 206. The gas line 206 of the gas transfer assembly 200 has a first or upstream end 208, which is connected to the natural gas source 20, and a second or downstream end 210, which is connected to the gas transfer assembly 12 of the gas compressor 10. A conduit 212 connects the gas line 206 with the compression assembly 202, as will be explained below. The gas transfer assembly 200 of the gas feed assembly 18 also includes a check valve 214, located between the conduit 212 and the upstream end 208 of the gas line 206. A check valve 215, a pressure switch 216, a relief valve 218, and a pressure gauge 220 are interposed in the gas line 206 between the conduit 212 and the downstream end 210 of the gas line 206 of the gas transfer assembly 200.

The compression assembly 202 of the gas feed assembly 18 includes a hydraulic cylinder 221. The hydraulic cylinder 221 may be constructed similarly to the first, second and third hydraulic cylinders 48, 50 and 52 of the gas compressor 10, or the hydraulic cylinder 200 may be constructed in any other suitable manner.

The hydraulic cylinder 221 of the compression assembly 202 has an upper end 222, a lower end 223 and an interior cavity 224 extending therebetween. A piston 225 is slidably disposed within the interior cavity 224 of the hydraulic cylinder 221 substantially as shown. The piston 225 divides the interior cavity 224 into a gas area 226 and a fluid area 227. An upper port 228 is formed in the hydraulic cylinder 221 allowing communication with the gas area 226 of the interior cavity 224 of the hydraulic cylinder 221. A lower port 229 is formed in the hydraulic cylinder 221, allowing communication with the fluid area 227 of the interior cavity 224 of the hydraulic cylinder 221.

The hydraulic cylinder 221 additionally includes a piston rod 230 movably attached to the piston 225 and extending through the lower end 223 of the hydraulic cylinder 221 via an aperture 231. A piston rod frame 232 is attached to the piston rod 230. A first spring 234 having a tension adjustment bolt 236 and a second spring 238 having a tension adjustment bolt 240 are also attached to the piston rod frame 232.

The compression assembly 202 of the gas feed assembly 20 additionally includes a limit switch 242 and a limit switch control rod 244. The limit switch control rod is attached to the piston rod frame 232, and the limit switch 242 is movably attached to the limit switch control rod 244.

The hydraulic assembly 204 of the gas feed assembly 20 includes a pressure line 246 attached to the lower end 223 of the hydraulic cylinder 221 via the lower port 229 so that fluid communication is established between the pressure line 246 and the fluid area 227 of the hydraulic cylinder 221. The pressure line 246 of the hydraulic assembly 204 additionally has an end 250 attached to a pump 252 which is in turn attached to a motor 254. The pump 252 is positioned to draw hydraulic fluid from a reservoir 256.

The hydraulic assembly 204 additionally includes a return line 258. The return line 258 is connected to the pressure line 246 between a first fluid control valve 260 and a second fluid control valve 262. A solenoid valve 264 is interposed in the return line 258 of the hydraulic assembly 204.

A four way solenoid valve 266 is interposed in the pressure line 246 of the hydraulic assembly 204 between a check valve 268 and the pump 252. A bypass line 270 is connected to the four way solenoid valve 266 and further connected to the return line 258. Additionally, the hydraulic assembly 204 has a relief line 272 connected to the pressure line 246 between the four way solenoid valve 266 and the pump 250. The relief line 272 is further connected to the return line 258 of the hydraulic assembly 204, and a relief valve 274 is interposed in the relief line 272 of the hydraulic assembly 204. A pressure gauge 278 is interposed in the pressure line 246 between the four way solenoid valve 266 and the relief line 272 of the hydraulic assembly 204.

The gas feed assembly 18 includes an electrical circuit (not shown). The electrical circuit of the gas feed assembly 18 includes a switch serially connected to the limit switch 242, the pressure switch 216, the solenoid valve 264 and the four way solenoid valve 266. As shown in FIG. 3, the solenoid valve 264 is open and the four way solenoid valve 266 is closed in the "open circuit" position. In the "open circuit" position the solenoid valve 264 is deemed herein to be open, and the four way solenoid valve 266 is deemed herein to be closed.

In operation gas from the natural gas source 20, which ordinarily will be at a pressure of approximately two to five p.s.i., enters the gas area 226 of the interior cavity 224 of the hydraulic cylinder 221 of the gas feed assembly 18. The first and second springs 234 and 238 connected to the piston rod frame 232 operate to hold the piston 225 in an armed position near a bottom end of the hydraulic cylinder 221. Gas is thereby allowed to enter the gas area 226. When the electric circuit of the gas feed assembly 18 is completed by closing the switch, the four way solenoid valve 266 allows hydraulic fluid to pass along the length of the pressure line 246 and the solenoid valve 264 closes, thereby prohibiting hydraulic fluid from flowing along the return line 258. Hydraulic fluid is pulled from the reservoir 256 by the pump 252 and transmitted under pressure along the pressure line 246 of the hydraulic assembly 204.

The rate of flow of hydraulic fluid along the pressure line 246 can be regulated as desired by the flow control valve 260. Hydraulic fluid enters the fluid area 227 of the hydraulic cylinder 221 via the lower port 229 of the hydraulic cylinder 221. The pressure of the hydraulic fluid on the piston 225 causes the piston 225 to rise, thereby compressing the gas contained in the gas area 226 of the interior cavity 224 of the hydraulic cylinder 221. The compressed gas exits the hydraulic cylinder 221 via the upper port 228 and the conduit 212 and is directed into the gas line 206 of the gas transfer assembly 200. The check valve 214 prevents the compressed gas from flowing toward the upstream end 208 of the gas line 206 of the gas transfer assembly 200.

When the piston 225 approaches the top of the hydraulic cylinder 221, the limit switch control rod 244 attached to the piston rod frame 232 opens the limit switch 242, thereby opening the circuit relative to the solenoid valve 264 and the four way solenoid valve 266. The solenoid valve 266 closes as shown in FIG. 3, routing hydraulic fluid pumped by the pump 250 via the bypass line 270 to the return line 258 and back to the reservoir 256 of the hydraulic assembly 204.

Additionally, the hydraulic fluid is forced from the cylinder 221 at least partially by gravity and partially by the downward pressure applied to the piston 225 by the first spring 234 and second spring 238 acting on the piston rod frame 232 which is attached to the piston rod 230 which is in turn movably attached to the piston 225 of the hydraulic cylinder 221. As the piston 225 moves downward, gas is drawn into the hydraulic cylinder 221 via the conduit 212 of the gas line 206.

The fluid exits the cylinder 221 via the lower port 229 and enters the receiving line 258 via the flow control valve 262. The flow control valve 262 is adjusted to prevent the piston 225 from slamming against the lower end of the hydraulic cylinder 221 as the piston 225 moves to the armed position. Hydraulic fluid in the return line 258 flows through the solenoid valve 264 to the reservoir 256.

As before mentioned, the gas transfer assembly 200 of the gas feed assembly 200 includes a pressure switch 216. The pressure switch 216 is set for a range of gas pressures, preferably from about eighty to about one hundred pounds p.s.i. If the gas pressure exceeds one hundred pounds p.s.i. the pressure switch 216 opens, thereby opening the electrical circuit and causing solenoid valves 264 and 266 to move to the opened and closed positions, respectively. If the pressure in the gas line 206 rises beyond a predetermined level for any reason the relief valve 218 opens, allowing gas to vent to the atmosphere or to a vent tank (not shown). If the pressure falls below a predetermined low pressure, the pressure switch 216 closes, thereby closing the electrical circuit and causing solenoid valves 264 and 266 to move to the closed and open position, respectively, causing another compression cycle to start.

Similarly, if the pressure in the pressure line 246 rises above a predetermined pressure for any reason, the relief valve 274 opens, thereby causing hydraulic fluid to be shunted from the pump to the return line 258 via the relief line 272 of the hydraulic assembly 204.

The gas feed assembly 18 can be constructed using the same hardware used in the construction of the gas compressor 10. Other satisfactory hardware, as known in the art, may also be used. Additionally, the gas feed assembly 18 can be any suitable commercially available single stage compressor which is preferably explosion proof.

Returning to FIG. 1, in operation the gas compressor 10 initially is in a non-operative mode (switch 192 shown in FIG. 2 is in the open position, thereby causing the circuit 190 to be open). With the circuit 190 open, the four way solenoid valve 176 connects a section of the pressure line 126 with the bypass line 178.

If power is applied to the pump 26 when the circuit 190 is open, hydraulic fluid is drawn from the reservoir 150 by the pump 148 and pumped into a section of the pressure line 126. However, the fluid is shunted to the return line 154 via the bypass line 178 and returned to the reservoir 150. Additionally, if the pressure in the above described section of the pressure line 126, as indicated by the pressure gauge 174, exceeds a predetermined point for any reason, the relief valve 172 opens, shunting the hydraulic fluid via relief line 170 to the return line 154 and thereafter to the reservoir 150.

With the circuit 190 open, solenoid valves 160, 164 and 168 are open, as shown in FIG. 1.

With power to the gas compressor 10 disabled, gas ordinarily is present in the gas transfer assembly 12. The gas fills the gas areas 66, 90 and 114 of the first, second and third hydraulic cylinders 48, 50 and 52, and additionally fills the storage cylinder 22. With a pressure from about forty to about one hundred p.s.i., the gas forces the pistons 64, 88 and 112 downward in the first, second and third hydraulic cylinders 48, 50 and 52.

Substantially all of the hydraulic fluid present in the fluid area 68 of the first hydraulic cylinder 48, in the fluid area 92 of the second hydraulic cylinder 50 and in the fluid area 116 of the third hydraulic cylinder 52 is at least partially forced out the fluid areas 68, 92 and 116 by the gas pressure on the pistons 64, 88 and 112.

The fluid in the first hydraulic cylinder 48 drains via the lower port 72, the fluid control valve 132, the first outflow line 158 and the first open solenoid valve 160 to the return line 154 and thereafter into the reservoir 150. The check valve 130 prevents the draining fluid from passing through the first receiving line 128.

The fluid in the second hydraulic cylinder 50 drains via the lower port 96, the fluid control valve 138, the second outflow line 162 and the open solenoid valve 164 to the return line 154 and thereafter into the reservoir 150. The relief valve 136 prevents the draining fluid from passing through the second receiving line 134.

Similarly the fluid in the third hydraulic cylinder 52 drains via the lower port 120, the fluid control valve 144, the third outflow line 166 and the open solenoid valve 168 to the return line 154 and thereafter into the reservoir 150. The relief valve 142 prevents the draining fluid from passing through the third receiving line 140.

The flow control valves 132, 138 and 144 are set at predetermined flow adjustments. The flow adjustments are chosen so that the rate of travel of the piston 64 within the first hydraulic cylinder 48 and of the piston 88 within the second hydraulic cylinder 50 is greater than the rate of travel of the piston 112 within the third hydraulic cylinder 52.

The flow adjustments are additionally chosen to cushion the downward movement of the pistons 64, 88 and 112 to prevent the pistons 64, 88 and 112 from slamming into the lower ends 58, 82 and 106 of the interior surfaces 60, 84 and 108 of the first, second and third hydraulic cylinders 48, 50 and 52, due to the gas pressure within the cylinders. The piston rods 74, 98 and 122 further act to stabilize the movement of the pistons 64, 88 and 112 within the interior cavities 62, 86 and 110 of the first, second and third hydraulic cylinders 48, 50 and 52.

When the pistons 64, 88 and 112 have traveled to a position generally adjacent the lower ends 58, 82 and 106 of the first, second and third hydraulic cylinders 48, 50, and 52, the pistons 64, 88 and 112 are considered to be in the armed position.

When the circuit 190 of the gas compressor 10 is closed, thereby starting a compression cycle, the solenoid valves 160, 164 and 168 close. Hydraulic fluid is thereby prevented from passing through the first, second and third outflow lines 158, 162 and 166. The four-way solenoid valve 176 opens, permitting hydraulic fluid to flow through the pressure line 126 to the first, second and third receiving lines 128, 134 and 140.

The pressure of the hydraulic fluid in the pressure line 126 opens the check valve 130 which allows hydraulic fluid to enter the fluid area 68 within the first hydraulic cylinder 48 via the receiving line 128. The pressure of the hydraulic fluid on the piston 64 causes the piston 64 to rise, compressing the gas within the gas area 66 of the first hydraulic cylinder 48. The gas is forced into the gas areas 90 and 114 of the second and third hydraulic cylinders 50 and 52. Gas is also forced into the connected storage tank 22. The check valves 36, 38 and 40 prevent the pressurized gas from passing to the first end 26 of the gas line 24.

The relief valve 136 in the receiving line 134 has been set to open at a predetermined pressure which is slightly greater than the pressure in the pressure line 126 when the piston 44 reaches the upward end 56 of the first hydraulic cylinder 48. The pressure at the predetermined pressure opens the relief valve 136, and fluid enters the fluid area 92 within the second hydraulic cylinder 50 via the second receiving line 134. The pressure of the hydraulic fluid on the piston 88 causes the piston 88 to rise, compressing the gas within the gas area 90 of the second hydraulic cylinder 50. The gas is forced into the gas area 114 of the third hydraulic cylinder 52. Gas is also forced into the connected storage cylinder 22.

In a similar manner the relief valve 142 in the third receiving line 140 has been set to open at a predetermined pressure which is slightly greater than the pressure in the pressure line 126 when the piston 88 reaches the upward end 80 of the second hydraulic cylinder 52. The pressure at the predetermined pressure opens the relief valve 142, and fluid enters the fluid area 116 within the third hydraulic cylinder 52 via the third receiving line 140. The pressure of the hydraulic fluid on the piston 112 causes the piston 112 to rise, compressing the gas within the gas area 114 of the third hydraulic cylinder 52. The gas is forced into the connected storage cylinder 22. The check valve 47 prevents the gas within the storage cylinder 22 from flowing toward the first end 26 of the gas line 24.

The piston rod 122 connected to the piston 112 rises along with the piston 112. As the piston rod 112 rises, the control rod 184 attached to the piston rod 122 also rises and, at a predetermined position, the control rod 184 opens the limit switch 182, thereby opening the circuit 190. Opening the circuit 190 causes the solenoid valves 160, 164 and 168 to open, as explained above. Fluid is thereby allowed to drain from the first, second and third hydraulic cylinders 48, 50 and 52, as previously discussed.

Opening of the limit switch 184 also causes the four way solenoid valve 176 to connect the bypass line 178 to the pressure line 126. Gas from the gas transfer assembly 12 again enters the gas areas 66, 90 and 114 of the first, second and third hydraulic cylinders 48, 50 and 52. The pressure of the incoming gas forces the pistons 64, 88 and 112 downward in the interior cavities 62, 86 and 110 of the first, second and third hydraulic cylinders 48, 50, and 52, having the effect of arming the pistons, as explained above.

The rate of flow of the hydraulic fluid from the first, second and third hydraulic cylinders 48, 50 and 52 is controlled by the flow control valves 132, 138 and 144, as previously explained. By controlling the respective rates of flow, the piston 112 of the third hydraulic cylinder 52 will be the last of the pistons to arm. When the control rod 184 attached to the piston rod 122 of the piston 112 moves downward to a predetermined position, the limit switch 182 is closed by the control rod 184, thereby closing the circuit 190. Closing the circuit 190 has the effect of closing the solenoid valves 160, 164 and 168 and of changing the connections of the four way solenoid valve 176, causing a second compression cycle to begin.

The gas compressor 10 will perform compression cycles until the switch 192 is opened or until the pressure switch 46 is opened, thereby opening the circuit 190. The pressure switch 46 is set for a predetermined range of pressure, the pressure being monitored at a position in the gas line 24 about adjacent the pressure switch 46. When the predetermined pressure range is reached or exceeded, the pressure switch 46 opens, thereby opening the circuit 190 and aborting the compression cycle in progress. It will be appreciated that if electric current to the electric current source 194 fails, the compression cycle similarly will be aborted.

If the pressure falls below the predetermined pressure range of the pressure switch 46, the pressure switch 46 closes. This has the effect of closing the circuit 190 and of initiating another compression cycle.

Figure 4:
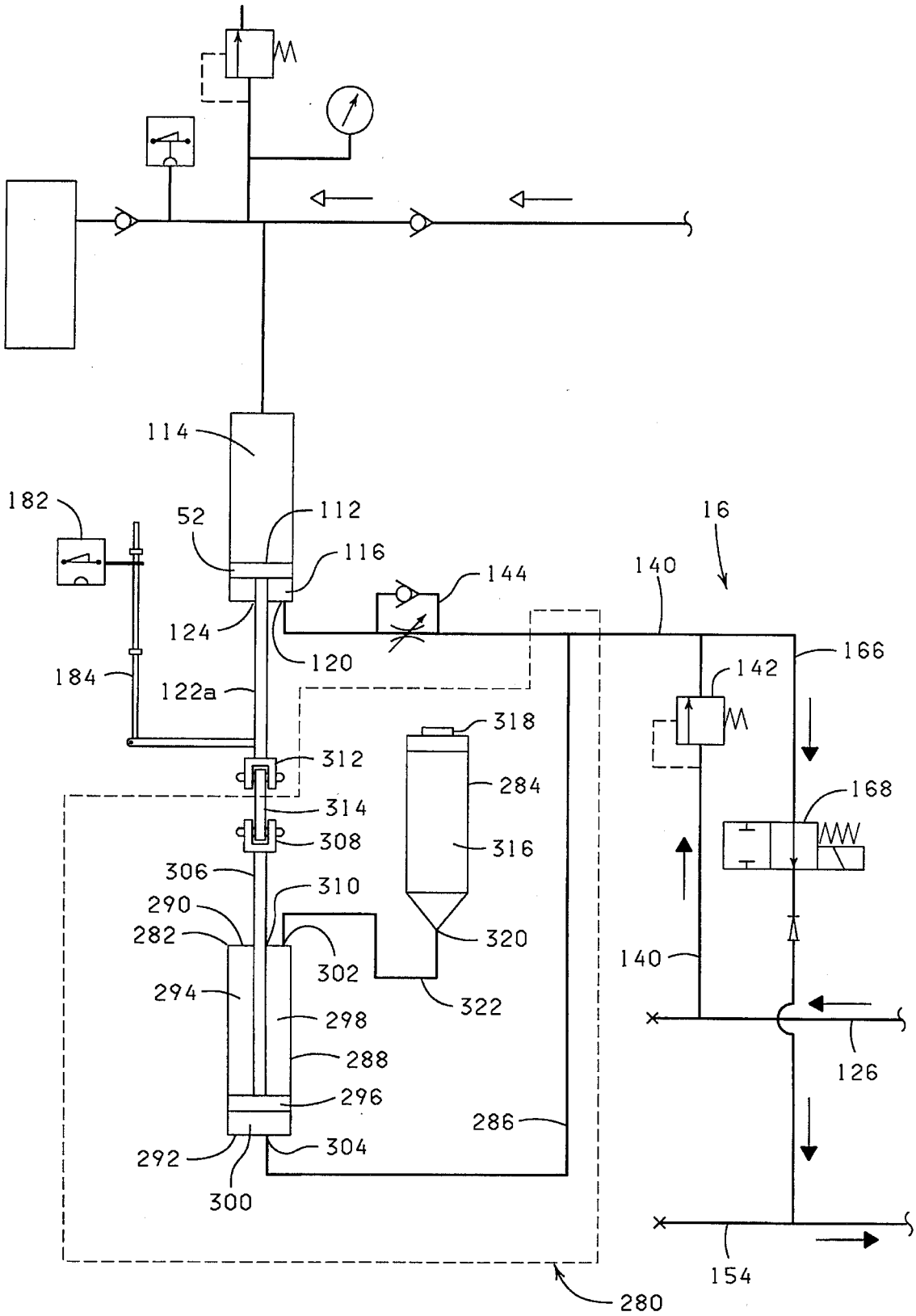
FIG. 4 is a partial diagrammatic, schematic view of the gas compressor of FIG. 1, having a pressure distribution assembly.

The efficiency and utility of the gas compressor 10 may be increased by incorporating into the gas compressor 10 one or more pressure distribution assemblies 280 as schematically illustrated in FIG. 4. Although the pressure distribution assembly 280 shown in FIG. 4 is connected to the third hydraulic cylinder 52 of the compression assembly 14 of the gas compressor 10, it is to be understood that pressure distribution assemblies 280 can be connected to any or all of the hydraulic cylinders of the gas compressor 10.

The pressure distribution assembly 280 accepts a portion of the pressure that would otherwise be applied to the fluid area 116 of the third hydraulic cylinder 52. The pressure distribution assembly 280 also transfers force obtained from the accepted pressure to the piston 112 of the third hydraulic cylinder 52, thereby assisting in the compression of gas contained in the gas area 114 of the third hydraulic cylinder 52.

The pressure distribution assembly 280 includes a relief hydraulic cylinder 282 connected to the third hydraulic cylinder 52. The pressure distribution assembly 280 also includes a fluid reservoir 284 connected to the relief hydraulic cylinder 282 and a pressure distribution line 286 connected to the relief hydraulic cylinder 282 and further connected to the third receiving line 140.

The relief hydraulic cylinder 282 of the pressure distribution assembly 280 includes a closed sidewall 288 having an upper end 290 and a lower end 292. The closed sidewall 288 of the relief hydraulic cylinder 282 defines an interior cavity 294 having a piston 296 slidingly contained therein. The piston 296 is sized and constructed to provide a seal between the piston 296 and an interior surface of the closed sidewall 288 of the relief hydraulic cylinder 282. The interior cavity 294 and the piston 296 further define an upper fluid area 298 and a lower fluid area 300.

The relief hydraulic cylinder 282 also is provided with an upper port 302 formed through the upper end 290 of the closed sidewall 288. A lower port 304 is formed through the lower end 292 of the closed sidewall 288 of the relief hydraulic cylinder 282. The relief hydraulic cylinder 282 further includes a piston rod 306 having a clevis 308. The piston rod 306 is movably attached to the piston 296 and extends through the upper end 292 of the closed sidewall 288 via an aperture 310.

In the embodiment of the gas compressor 10 shown in FIG. 4, the piston rod 306 of the relief hydraulic cylinder 282 is attached to the piston rod **122*a* of the third hydraulic cylinder 52. The construction and operation of the piston rod 122*a* is the same as that of the piston rod 122 shown in FIG. 1; however, a clevis 312 has been attached to a free end of the piston rod 122*a***.

The clevis 312 of the piston rod **122*a* is connected to the clevis 308 of the piston rod 306 of the relief hydraulic cylinder 282 by way of a connection rod 314. The connection of the piston rod 122*a* and the piston rod 306 forces the piston 112 of the third hydraulic cylinder 52 and the piston 296 of the relief hydraulic cylinder 282** to move in unison.

The pressure distribution assembly 280 also includes a fluid reservoir 284. The fluid reservoir 284 includes an interior cavity 316 which is at least partially filled with hydraulic fluid. The fluid reservoir also includes a vented cap 318. The vented cap 318 allows the egress and ingress of air into the interior cavity 316 of the fluid reservoir 284.

The fluid reservoir 284 includes a port 320 which allows fluid communication with the interior cavity 316 of the fluid reservoir 284. The interior cavity 316 of the fluid reservoir 284 is connected to the upper fluid area 298 of the relief hydraulic cylinder 282 by way of a fluid transfer line 322. The fluid transfer line 322 is connected to the port 320 of the fluid reservoir 284 and to the upper port 302 of the relief hydraulic cylinder 282.

The fluid reservoir 284 is positioned relative to the relief hydraulic cylinder 282 in such a manner that hydraulic fluid can flow, by way of the fluid transfer line 322 and at least partially assisted by gravity, from the interior cavity 316 of the fluid reservoir 284 to the upper fluid area 298 of the relief hydraulic cylinder 282 when the piston 296 approaches an armed position within the interior cavity 294 of the relief hydraulic cylinder 282, as shown in FIG. 4.

The pressure distribution assembly 280 additionally includes a pressure distribution line 286. The pressure distribution line 286 is connected to the third receiving line 140 of the hydraulic assembly 16. The pressure distribution line 286 is connected to the third receiving line 140 between the relief valve 142 and the flow control valve 144. The pressure distribution line 286 is further connected to the lower fluid area 300 of the relief hydraulic cylinder 282. The pressure distribution line 286 permits fluid communication between the third receiving line 140 of the hydraulic assembly 16 and the lower fluid area 300 of the relief hydraulic cylinder 282 of the pressure distribution assembly 280.

In operation, fluid under pressure in the third receiving line 140 of the hydraulic assembly 16 enters the fluid area 116 of the third hydraulic cylinder 52 and the lower fluid area 300 of the relief hydraulic cylinder 282, by way of the pressure distribution line 286. The piston 296 of the relief hydraulic cylinder 282 is forced upward by the pressure of the fluid in the lower fluid area 300. The piston 112 of the third hydraulic cylinder 52 is also forced upward by the pressure of the fluid in the fluid area 116.

Force is transferred from the piston 296, by way of the piston rods 306 and 122*a* to the piston 112 of the third hydraulic cylinder 52, thereby assisting in the compression of gas within the gas area 114 of the third hydraulic cylinder 52 of the compression assembly 14. The upward movement of the piston 296 also forces hydraulic fluid from the upper fluid area 298 of the relief hydraulic cylinder 282 and into the interior cavity 316 of the fluid reservoir 284 by way of the fluid transfer line 322.

When pressure is removed from the third receiving line 140, hydraulic fluid flows from the fluid area 116 of the third hydraulic cylinder 52 into the third receiving line 140, at least partially assisted by the pressure of gas entering the gas area 114 of the third hydraulic cylinder 52, as explained above. When pressure is removed from the third receiving line 140, hydraulic fluid also flows from the lower fluid area 300 of the relief hydraulic cylinder 282, at least partially assisted by the weight of hydraulic fluid entering the upper fluid area 298 of the relief hydraulic cylinder 282 by force of gravity. The movement of the interconnected pistons 112 and 296 within the third hydraulic cylinder 52 and the relief hydraulic cylinder 282 respectively, is restricted by the rate of flow of hydraulic fluid through the flow control valve 144, as explained above.

Changes may be made in the embodiments of the invention described herein or in parts or elements of the embodiments described herein or in the steps or in the sequence of steps of the methods described herein without departing from the spirit and scope of the invention as defined in the following claims.

What is claimed is:

1. A method of compressing gas, comprising the steps of:

connecting a storage tank to an interior cavity of a first hydraulic cylinder, to an interior cavity of at least one second hydraulic cylinder, and to an interior cavity of a third hydraulic cylinder;

connecting the interior cavities of the first, second and third hydraulic cylinders to a gas source supplying a gas;

introducing gas into the interior cavities of the first, second and third hydraulic cylinders and the storage tank;

introducing hydraulic fluid into the interior cavity of the first hydraulic cylinder to compress the gas contained therein and pushing the gas from the interior cavity of the first hydraulic cylinder into the interior cavities of the second and third hydraulic cylinders and into the storage tank, while preventing gas from passing from the interior cavity of the first hydraulic cylinder to the gas source;

introducing hydraulic fluid into the interior cavity of the second hydraulic cylinder to compress the gas contained therein and pushing the gas from the interior cavity of the second hydraulic cylinder into the interior cavity of the third hydraulic cylinder and into the storage tank, while preventing gas from passing from the interior cavity of the second hydraulic cylinder to the interior cavity of the first hydraulic cylinder and to the gas source;

introducing hydraulic fluid into the interior cavity of the third hydraulic cylinder to compress the gas contained therein and pushing the gas from the interior cavity of the third hydraulic cylinder into the storage tank, while preventing gas from passing from the interior cavity of the third hydraulic cylinder to the interior cavities of the first and second hydraulic cylinders and to the gas source; and draining the hydraulic fluid from the interior cavities of the first, second and third hydraulic cylinders while preventing gas in the storage tank from passing to the interior cavities of the first, second and third hydraulic cylinders and to the gas source.

2. The method of claim 1 wherein the step of draining the hydraulic fluid further comprises controlling the flow of hydraulic fluid from the interior cavities of the first, second and third hydraulic cylinders so that hydraulic fluid is drained from the interior cavities of the first and second hydraulic cylinders prior to draining hydraulic fluid from the interior cavity of the third hydraulic cylinder.

3. The method of claim 1 wherein the step of introducing gas into the interior cavities of the first, second and third hydraulic cylinders further comprises pressurizing the gas to a sufficient initial pressure prior to introduction of the gas into the interior cavities of the first, second and third hydraulic cylinders.

4. The method of claim 1 wherein the steps of:

introducing gas into the interior cavities of the first, second and third hydraulic cylinders and introducing hydraulic fluid into the interior cavities of the first, second and third hydraulic cylinders further comprise completing a compression stage.

5. The method of claim 4 further comprising the step of aborting the compression stage when the pressure in the storage tank reaches a pressure within a predetermined range of pressures.

6. The method of claim 1 further comprising the step of initiating the draining of the hydraulic fluid from the interior cavities of the first, second and third hydraulic cylinders when the hydraulic fluid in the interior cavity of the third hydraulic cylinder reaches a predetermined position.

* * * * *

UNITED STATES PATENT AND TRADEMARK OFFICE

CERTIFICATE OF CORRECTION

PATENT NO. : 5,622,478

DATED : April 22, 1997

INVENTOR(S) : Elliott et al.

It is certified that error appears in the above-identified patent and that said Letters Patent is hereby corrected as shown below:

Column 4, line 49, please delete " ½ " and substitute therefor --½"--.

Column 5, line 20, please delete " ½ " and substitute therefor --½"--.

Signed and Sealed this

Fifteenth Day of July, 1997

Bruce Lehman

*Attest:*

BRUCE LEHMAN

*Attesting Officer*

*Commissioner of Patents and Trademarks*